US006317120B1

(12) United States Patent
Eu

(10) Patent No.: US 6,317,120 B1
(45) Date of Patent: Nov. 13, 2001

(54) VOLTAGE GENERATING CIRCUIT FOR LIQUID CRYSTAL DISPLAY PANEL

(75) Inventor: Jung Taek Eu, Kyungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/095,756

(22) Filed: Jun. 11, 1998

(30) Foreign Application Priority Data

Jul. 28, 1997 (KR) ..... 97-35570

(51) Int. Cl.[7] ..... G09G 3/36
(52) U.S. Cl. ..... 345/211; 345/95; 345/92
(58) Field of Search ..... 345/87, 90–94, 345/95–97, 211, 208–210; 349/33; 323/225, 297; 368/203, 204

(56) References Cited

U.S. PATENT DOCUMENTS 5,229,761 7/1993 Fuse ..... 345/211
5,510,814 * 4/1996 Ise ..... 345/211
5,657,039 * 8/1997 Mizukata et al. ..... 345/95
5,754,151 * 5/1998 Moon ..... 345/92
5,859,632 * 1/1999 Ito ..... 345/211
5,867,138 * 2/1999 Moon ..... 345/92

* cited by examiner

*Primary Examiner*—Lun-Yi Lao

(57) ABSTRACT

A voltage generating circuit for driving a liquid crystal display panel with a simplified circuit configuration generates a plurality of voltage signals necessary to drive the liquid crystal display panel. The voltage generating circuit includes a reference node having a voltage level varying according to a line pulse, a plurality of reference voltage sources supplying reference voltage signals having different voltage levels, and a plurality of capacitors, coupled to said reference node and to said reference voltage sources, for generating a plurality of driving voltage signals according to the line pulse.

19 Claims, 4 Drawing Sheets

VOLTAGE GENERATING CIRCUIT FOR LIQUID CRYSTAL DISPLAY PANEL

BACKGROUND OF THE INVENTION

1. Field of the Invention

This invention relates to an apparatus for driving a liquid crystal display (LCD) panel, and more particularly, to a voltage generating circuit for generating a plurality of voltage signals required to drive the LCD panel.

2. Description of the Conventional Art

A conventional LCD panel controls transmission of a light beam from a light source according to an input video signal to display a picture corresponding to the input video signal. The conventional LCD panel includes liquid crystal cells arranged in a matrix pattern and control switches for selectively activating the cells to receive the input video signals.

A driving apparatus is provided in the conventional LCD to actuate the control switches for activating the liquid crystal cells. The driving apparatus changes the polarity of video, voltage signals applied to the cells between a positive (+) and negative(−) polarity according to a set voltage level. This reduces the amount of driving voltage needed to drive the LCD panel and avoids degradation of liquid crystal. To change the polarity of video voltage signals, the driving apparatus must supply voltage signals for controlling the control switches and also a common voltage having a constant voltage level to each liquid crystal cell.

To generate the common voltage and the voltage signals for the control switches, a conventional LCD driving apparatus requires many different voltage generating circuits.

As shown in FIG. 1, the conventional LCD panel includes a plurality of thin film transistors (TFTs) 10 arranged at crossovers where gate lines 11 intersect data lines 13, a plurality of liquid crystal cells 12 each connected between the source of a correspondence TFT 10 and the common voltage Vcom, a plurality of support capacitors 14 each connected in parallel with the corresponding liquid crystal cell 12, a plurality of gate drivers 16 connected to the gate lines 11, and a plurality of data line drivers 25 for supplying video signals to the data lines 13. The LCD panel further includes a first pad 15 for inputting the common voltage Vcom, second pads 17 for inputting a gate floating voltage Vst, a third pad 19 for inputting a first gate driving voltage Vgh, and a fourth pad 21 for inputting a second gate driving voltage Vgl.

As shown in FIG. 2, each of the gate drivers 16 includes an NMOS transistor 18 and a PMOS transistor 20 for commonly receiving a gate control signal from a gate control line 23. The NMOS transistor 18 transfers the first gate driving voltage Vgh from the third pad 19 to the gate line 11 when the gate control signal has a logical value of "1". On the other hand, the PMOS transistor 20 transfers the second gate driving voltage Vgl from the fourth pad 21 to the gate line 11 when the gate control signal has a logical value of "0".

To generate the common voltage Vcom, the gate floating voltage Vst and the first and second gate driving voltages Vgh and Vgl required by the LCD panel, the conventional LCD panel requires separate voltage generating circuits as shown in FIGS. 3 to 5. These voltage generating circuits included in the conventional LCD panel will be explained below referring to FIGS. 3 to 5.

First, the common voltage Vcom is commonly supplied, via the first pad 15, to a number of liquid crystal cells 12 and support capacitors 14. The gate floating voltage Vst is commonly supplied, via the second pads 17, to the gate lines 11. The common voltage Vcom and the gate floating voltage Vst are produced by a first voltage generating circuit as shown in FIG. 3.

The first voltage generating circuit includes an operational amplifier A1 for differentially amplifying a reference signal Vref and a horizontal synchronous signal Hsy, push-pull amplifiers Q1 and Q2 for further amplifying an output signal of the operational amplifier A1, and a resistor R1 and capacitor Q1 connected in parallel with each other for feeding back the output signal of the push-pull amplifiers Q1 and Q2 to be added to a line pulse LS. These push-pull amplifiers Q1 and Q2 generate the output signal of the operational amplifier A1 by utilizing a high level supply voltage +Vcc and a low level supply voltage −Vcc. Each output signal of the push-pull amplifiers Q1 and Q2 is applied to the first pad 15 (FIG. 1) as a common voltage Vcom or to the second pad 17 as a gate floating voltage Vst. The voltage level of each output signal of the push-pull amplifiers Q1 and Q2 is determined by the voltage level of the reference voltage Vref.

Second, the first gate driving voltage Vgh is commonly supplied, via the third pad 19, to the gate drivers 16 and is generated by a second voltage generating (or clamping) circuit as shown in FIG. 4. The second voltage generating circuit includes a diode D1 connected between the high level supply voltage source Vcc and the third pad 19, and a capacitor C2 connected between a line pulse (LS) input node HIN and the third pad 19. The capacitor C2 accumulates a difference between the voltage of line pulse LS and the high level supply voltage supplied through the diode D1 from the high level voltage source Vcc. As a result, the first gate driving voltage Vgh changing in accordance with a logical value of the line pulse LS is generated and supplied to the third pad 19.

Finally, the second gate driving voltage Vgl is commonly supplied, via the fourth pad 21, to the gate drivers 16 and is generated by a third voltage generating (clamping) circuit as shown in FIG. 5. The third voltage generating circuit includes a diode D2 connected between a low level supply voltage source −Vcc and the fourth pad 21, and a capacitor C3 connected between the line pulse (LS) input node HIN and the fourth pad 21. The capacitor C3 accumulates a difference between the voltage of line pulse LS and the low level supply voltage applied through the diode D2 from the low level voltage source −Vcc. The second gate driving voltage Vgl changing in accordance with a logical value of the line pulse LS is generated and supplied to the fourth pad 21.

As described above, the conventional LCD panel driving apparatus requires at least several voltage generating circuits to generate all of the control voltage signals required to drive the LCD panel. This results in a complicated circuit configuration and more frequent circuit failures.

SUMMARY OF THE INVENTION

Accordingly, it is an object of the present invention to provide a voltage generating circuit for an LCD panel with a simplified circuit configuration, which is capable of generating a plurality of voltage signals necessary to drive the LCD panel.

It is another object of the present invention to provide a voltage generating circuit for an LCD panel which overcomes problems and disadvantages encountered in conventional LCD panels.

In order to attain these and other objects of the invention, a voltage generating circuit for a liquid crystal display panel according to the present invention includes a reference node, responsive to a line pulse having a logical value inverted every horizontal scanning interval, and having a voltage level varying according to the logical value of the line pulse; at least two reference voltage sources for generating voltage signals having different voltage levels; and at least two clamping means, coupled to the reference node, the reference voltage sources and the output nodes, for clamping at least two voltage signals from the reference voltage sources with a voltage of the line pulse, and for generating at least two control voltage signals to drive the liquid crystal display panel.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the embodiments of the present invention are directed to a voltage generating circuit for driving a liquid crystal display panel, including a reference node responsive to a line pulse; at least two output nodes for outputting driving voltage signals; at least two reference voltage sources supplying reference voltage signals to the output nodes; direction control means, coupled to the reference voltage sources and to the output nodes, for directing a flow of the reference voltage signals; and at least two voltage accumulating means, coupled between the reference node and the output nodes, for accumulating voltages to be output as the driving voltage signals.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENTS

Figure 6:
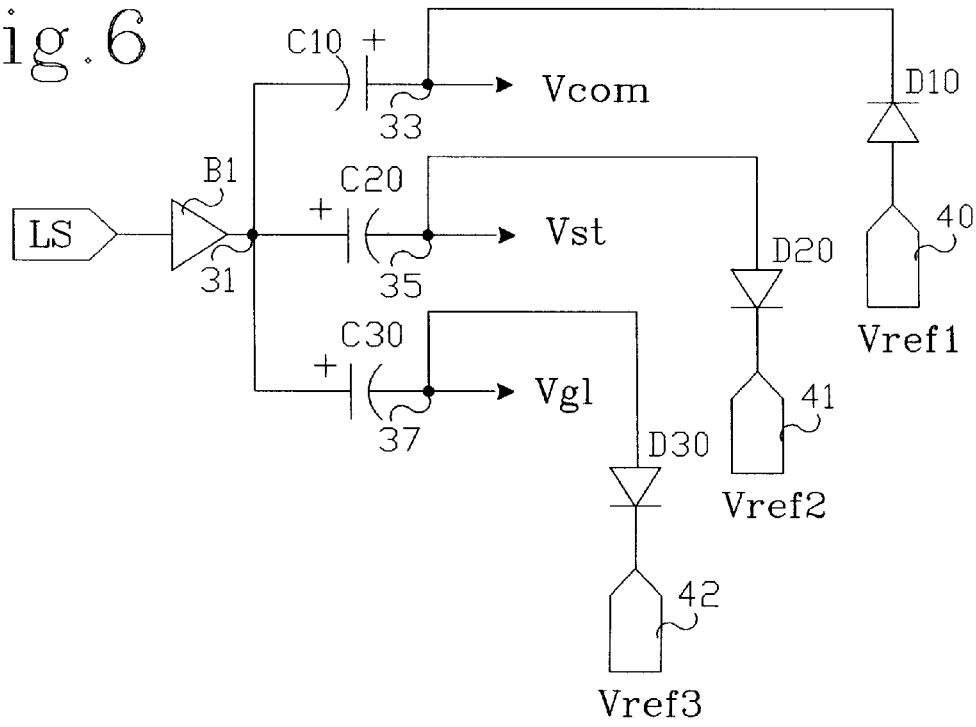
FIG. 6 illustrates a voltage generating circuit for an LCD panel according to an embodiment of the present invention.

Referring to FIG. 6, there is shown a voltage generating circuit for an LCD panel according to the first embodiment of the present invention. This circuit generates a common voltage Vcom, a gate floating voltage Vst, and a second gate driving voltage Vgl.

As shown in FIG. 6, the voltage generating circuit includes a buffer B1 for receiving a line pulse LS, a first capacitor C10 connected between a reference node 31 and a first output node 33, and a first diode D10 connected between a first reference voltage source 40 and the first output node 33. The buffer B1 delivers the line pulse LS voltage to the reference node 31 and prevents the voltage at the reference node 31 from influencing the input line pulse LS. The line pulse LS has a logical value changing at every period of horizontal synchronous signals. The line pulse LS has a logical value of "0" during the period of odd-numbered horizontal synchronous signals and a logical value of "1" during the period of even-numbered horizontal synchronous signals. Accordingly, the voltage at the reference node 31 has two levels as the logical value of the line pulse LS changes. More specifically, the first level voltage (e.g., 0 V) appears on the reference node 31 during the period of odd-numbered horizontal synchronous signals in which the line pulse LS has a logical value of "0", while the second level voltage (e.g., 4.2 V) appears on the reference node 31 during the period of even-numbered horizontal synchronous signals in which the line pulse LS has a logical value of "1".

Figure 1:
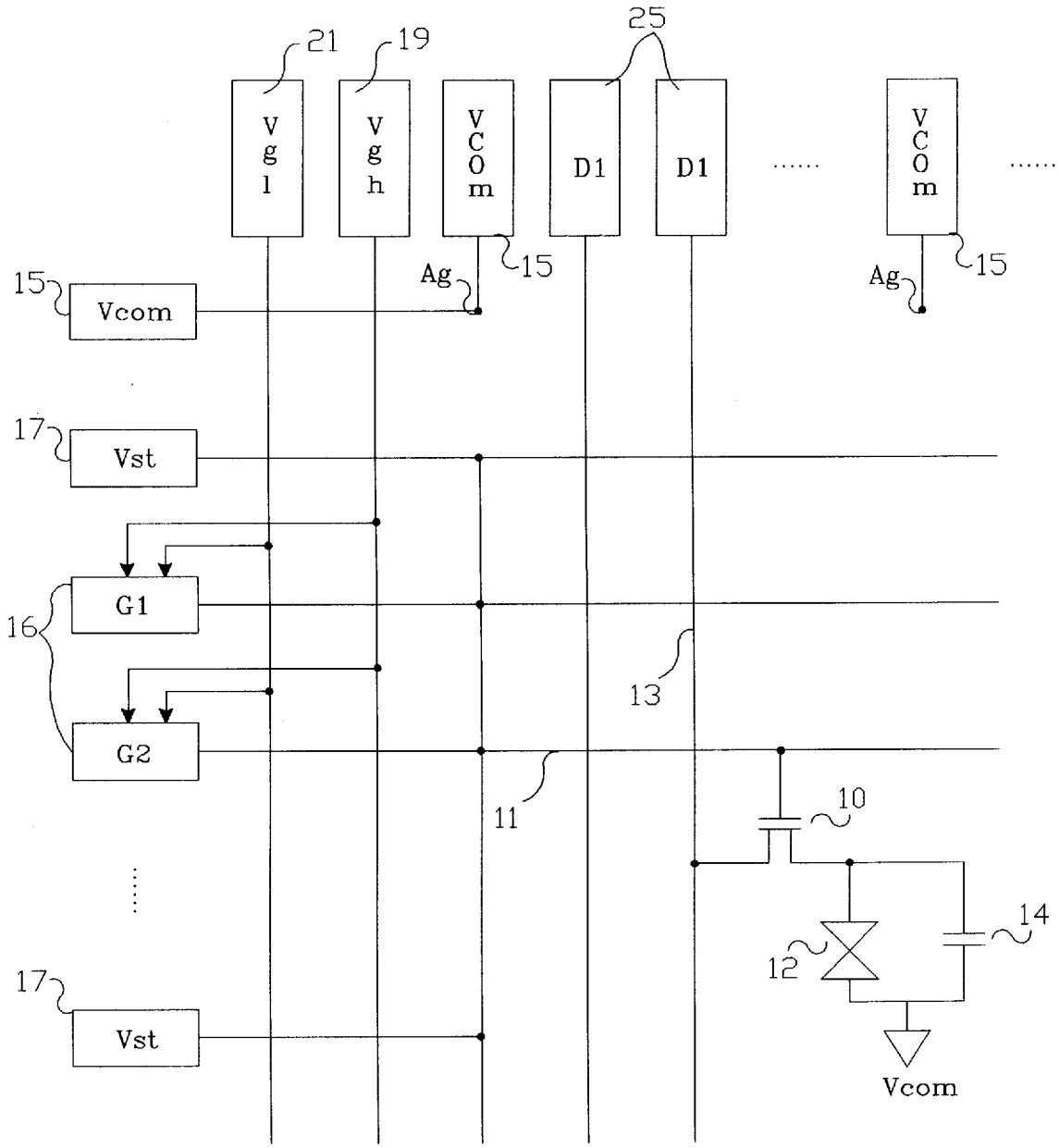
Fig. 1 CONVENTIONAL ART
FIG. 1 is a schematic view showing a configuration of a conventional LCD panel.
Figure 2:
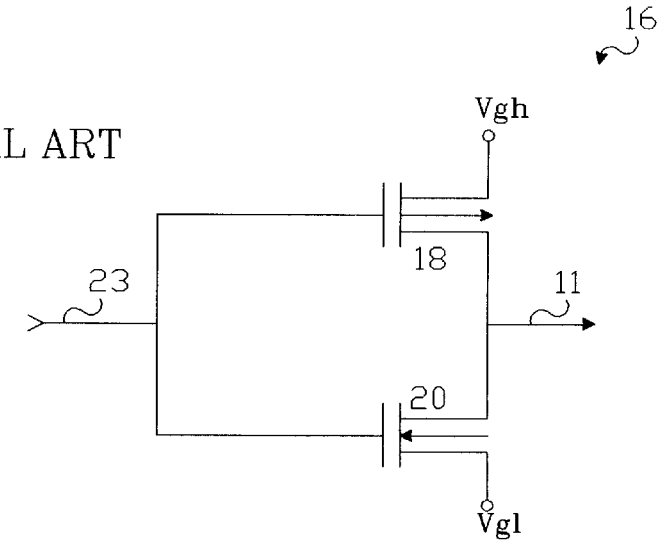
Fig.2 CONVENTIONAL ART
FIG. 2 is a detailed circuit diagram of a gate driver shown in FIG. 1.
Figure 3:
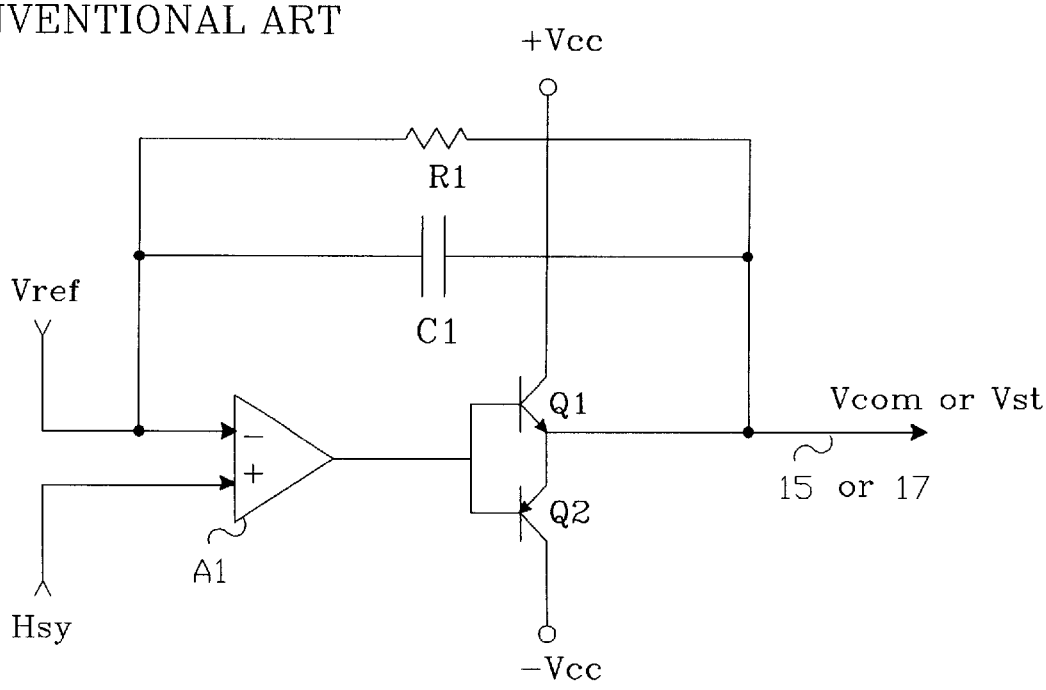
Fig.3 CONVENTIONAL ART
FIG. 3 illustrates a first conventional voltage generating circuit for generating a common voltage Vcom and a gate floating voltage Vst for the LCD panel of FIG. 1.
Figure 4:
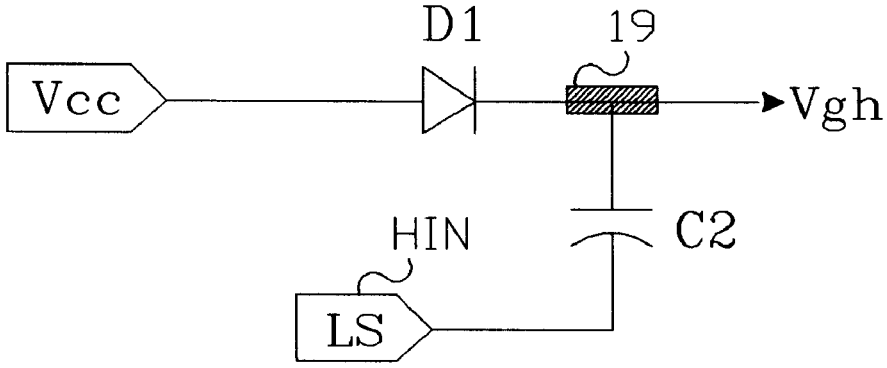
Fig. 4 CONVENTIONAL ART
FIG. 4 illustrates a second conventional voltage generating circuit for generating a gate driving voltage Vgh required by the gate driver shown in FIG. 2.
Figure 5:
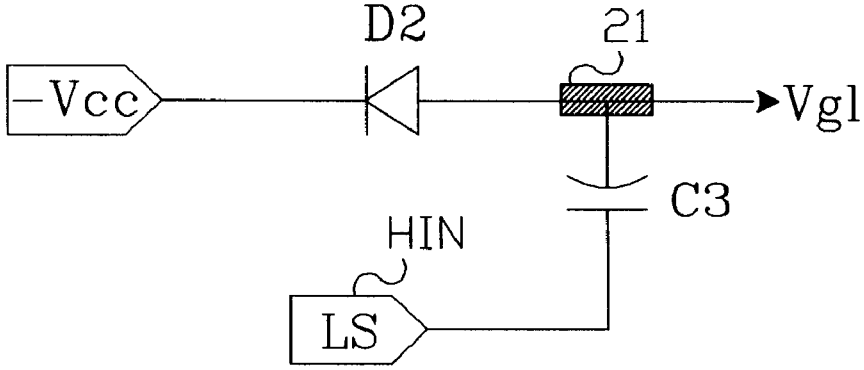
Fig. 5 CONVENTIONAL ART
FIG. 5 illustrates a third conventional voltage generating circuit for generating another gate driving voltage Vgl required by the gate driver shown in FIG. 2.

The first diode D10 delivers a first reference voltage Vref1 from the first reference voltage source 40 to the output node 33 and at the same time, prevents the voltage at the node 33 from feeding back to the first reference voltage source 40. The first capacitor C10 accumulates the first reference voltage Vref1 supplied through the first diode D1. As a result, a voltage signal having a voltage level varying in accordance with a logical value of the line pulse LS at the node 31 is output from the node 33 as the common voltage Vcom. For example, assuming that the first reference voltage Vref1 is set to "−15 V", the voltage signal at the output node 33 remains at "−3.2 V" during the period of even-numbered horizontal synchronous signals in which the line pulse LS has a logical value of "1". On the other hand, the voltage at the output node 33 remains at "+1.0 V" during the period of odd-numbered horizontal synchronous signals in which the line pulse LS has a logical value of "0". The voltage signal at the node 33 is supplied as the common voltage Vcom to liquid crystal cells of an LCD panel, such as one shown in FIG. 1. In order to maintain the first reference voltage Vref1 with stability, the first reference voltage source 40 includes an operational amplifier (not shown).

The voltage generating circuit according to the first embodiment of the present invention further includes a second capacitor C20 connected between the reference node 31 and a second output node 35, and a second diode D20 connected between a second reference voltage source 41 and the second output node 35. The second diode D20 delivers a voltage signal supplied via the second capacitor C20 from the node 31 to the second reference voltage source 41. At the same time, the second diode D20 prevents the voltage signal of the second reference voltage source 41 from affecting the second output node 35. The second capacitor C20 accumulates the second reference voltage Vref2 applied through the second diode D20 in the reverse direction, whereby a voltage accumulated on the basis of the voltage at the reference node 31 emerges from the second output node 35. The voltage signal emerging from the second output node 35 has a voltage level varying in accordance with a logical value of the line pulse LS. For example, assuming that the second reference voltage Vref2 is set to "−13 V", the voltage signal at the second output node 35 is maintained at a level of "−17.2 V" during the period of even-numbered horizontal synchronous signals in which the line pulse LS has a logical value of "1", and at a voltage level of "−13.0 V" during the period of odd-numbered horizontal synchronous signals in which the line pulse LS has a logical value of "0". The voltage signal from the second output node 35 is supplied to the gate lines of the LCD panel, such as one shown in FIG. 1, as a gate floating voltage Vst.

In addition to generating the common voltage Vcom and gate floating voltage Vst, the voltage generating circuit also generates a gate driving voltage Vgl for the LCD panel. The circuit includes a third capacitor C30 connected between the reference node 31 and a third output node 37, and a third diode D30 connected between a third reference voltage source 42 and the third output node 37. The third diode D30 delivers a voltage signal at the reference node 31 supplied via the third capacitor C30 to the third reference voltage source 42. The third diode D30 also prevents the voltage signal from the third reference voltage source 42 from affecting the third output node 37. The third capacitor C30 accumulates the third reference voltage Vref3 applied via the third diode D3 in the reverse direction, whereby a voltage accumulated on the basis of the voltage at the reference node 31 emerges from the third output node 37. This voltage signal emerging from the third output node 37 has a voltage level varying in accordance with a logical value of the line pulse LS. For example, assuming that the third reference voltage Vref3 is set to "−15 V", the voltage signal at the third output node 37 is maintained at "−19.2 V" during the period of even-numbered horizontal synchronous signals in which the line pulse LS has a logical value of "1", and at "−15.0 V" during the period of odd-numbered horizontal synchronous signals in which the line pulse LS has a logical value of "0". The voltage signal at the third output node 37 is supplied to the gate drivers of the LCD panel, such as one shown in FIG. 1, as a gate driving voltage Vgl.

Figure 7:
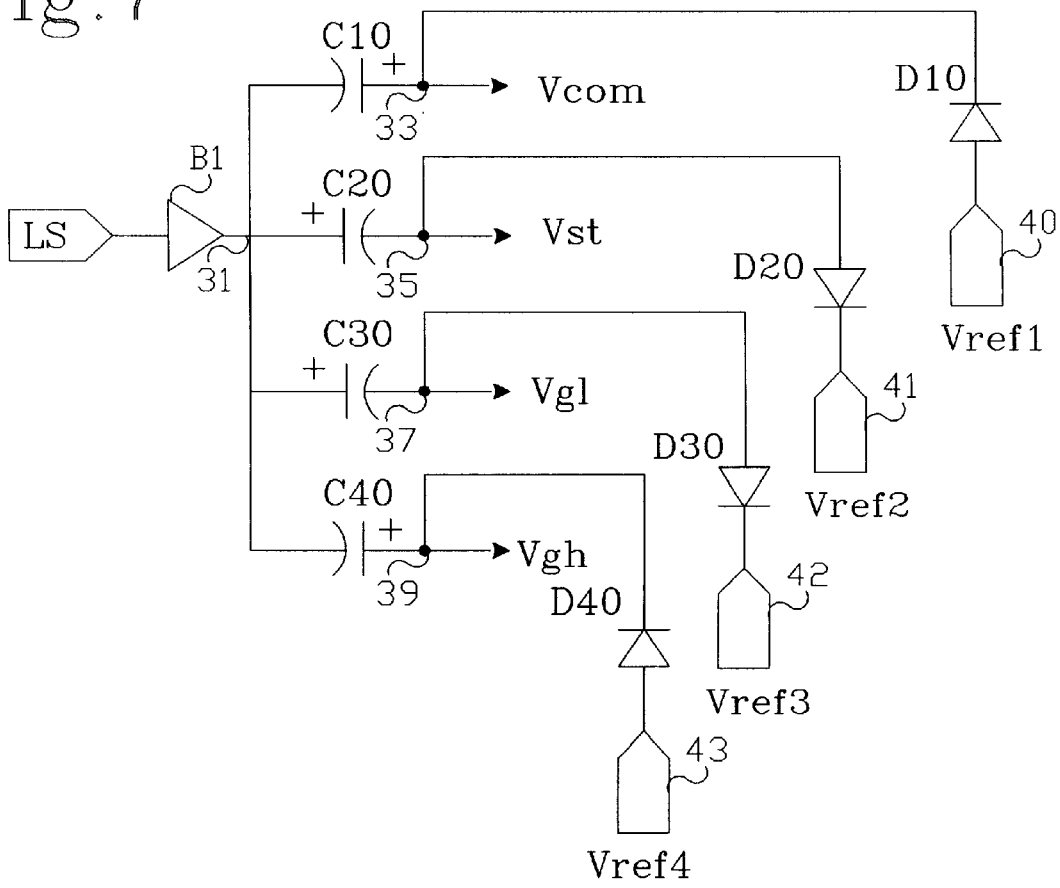
FIG. 7 illustrates a voltage generating circuit for an LCD panel according to another embodiment of the present invention.

Referring to FIG. 7, there is shown a voltage generating circuit for an LCD panel according to the second embodiment of the present invention. This voltage generating circuit generates a common voltage Vcom, a gate floating voltage Vst, and gate driving voltages Vgh and Vgl.

As shown in FIG. 7, the circuit includes a buffer B1 for receiving the line pulse LS, a first capacitor C10 connected between a reference node 31 and a first output node 33, and a first diode D10 connected between the first reference voltage 40 and the first output node 33. The buffer B1 delivers a voltage of the line pulse LS to the reference node 31, and prevents the voltage at the reference node 31 from affecting the input line pulse LS. The line pulse LS has a logical value changing at every period of horizontal synchronous signals. For example, the line pulse LS is maintained at a logical value of "0" during the period of odd-numbered horizontal synchronous signals, and at a logical value of "1" during the period of even-numbered horizontal synchronous signals. The voltage of the reference node 31 varies between two levels as the logical value of the line pulse LS changes. More specifically, the first level voltage (e.g., "0 V") appears on the reference node 31 during the period of odd-numbered horizontal synchronous signals in which the line pulse LS has a logical value of "0", while the second level voltage (e.g., "4.2 V") appears on the reference node 31 during the period of even-numbered horizontal synchronous signals in which the line pulse LS has a logical value of "1".

The first diode D10 delivers the first reference voltage Vref1 from the first reference voltage source 40 to the first output node 33, and at the same time, prevents feeding back of the voltage at the first output node 33 to the first reference voltage source 40. The first capacitor C10 accumulates the first reference voltage. Vref1 applied via the first diode D1, whereby a voltage is accumulated on the basis of the voltage on the reference node 31 and output from the first output node 33.

The voltage signal emerging from the first output node 33 has a voltage level varying in accordance with a logical value of the line pulse LS. For example, assuming that the first reference voltage Vref1 is set to "−15 V", a voltage signal at the first output node 33 is maintained at "−3.2 V" during the period of even-numbered horizontal synchronous signals in which the line pulse LS has a logical value of "1", and at "+1.0 V" during the period of odd-numbered horizontal synchronous signals in which the line pulse LS has a logical value of "0". The voltage signal at the first output node 33 is supplied, as a common voltage Vcom, to the liquid crystal cells of an LCD panel, such as one shown in FIG. 1. In order to maintain the first reference voltage Vref1 in a stable condition, the first reference voltage source 40 includes an operational amplifier (not shown).

The voltage generating circuit according to the second embodiment of the present invention further includes a second capacitor C20 connected between the reference node 31 and a second output node 35, and a second diode D20 connected between the second reference voltage source 41 and the second output node 35. The second diode D20 delivers the voltage signal at the reference node 31 supplied via the second capacitor C2 to the second reference voltage source 41. At the same time, the second diode D20 prevents the voltage from the second reference voltage source 41 from affecting the second output node 35. The second capacitor C20 accumulates the second reference voltage Vref2 applied via the second diode D20 in the reverse direction. Therefore, a voltage is accumulated at the second output node 35 on the basis of the voltage at the reference node 31 and output therefrom as a gate floating voltage Vst. The voltage signal emerging from the second output node 35 has a voltage level varying in accordance with a logical value of the line pulse LS. For example, assuming that the second reference voltage Vref2 is set to "−13 V", the voltage signal at the second output node 35 is maintained at the level of "−17.2 V" during the period of even-numbered horizontal synchronous signals in which the line pulse LS has a logical value of "1", and at the level of "−13.0 V" during the period of odd-numbered horizontal synchronous signals in which the line pulse LS has a logical value of "0". The voltage signal at the second output node 35 is supplied to the gate lines of the LCD panel, such as one shown in FIG. 1.

The voltage generating circuit further includes a third capacitor C30 connected between the reference node 31 and a third output node 37, and a third diode D30 connected between the third reference voltage source 42 and the third output node 37. The third diode D30 delivers a voltage signal at the reference node 31 supplied via the third capacitor C30 to the third reference voltage source 42. At the same time, the third diode D30 prevents the voltage from the third reference voltage source 42 from feeding back to the third output node 37. The third capacitor C30 accumulates the third reference voltage Vref3 applied via the third diode D30 in the reverse direction. The voltage accumulated at the third node 37 on the basis of the voltage at the reference node 31 is output as a gate driving voltage Vgl. The gate driving voltage Vgl has a voltage level varying in accordance with a logical value of the line pulse LS. For example, assuming that the third reference voltage Vref3 is set to "−15 V", the voltage signal at the third output node 37 is maintained at the level of "−19.2 V" during the period of even-numbered horizontal synchronous signals in which the line pulse LS has a logical value of "1", and at the level of "−15.0 V" during the period of odd-numbered horizontal synchronous signals in which the line pulse LS has a logical value of "0". The voltage at the third output node 37 is supplied to the gate drivers of the LCD panel, such as one shown in FIG.1.

The voltage generating circuit according to the second embodiment of the present invention further includes a fourth capacitor C40 connected between the reference node 31 and a fourth output node 39, and a fourth diode D40 connected between a fourth reference voltage source 43 and the fourth output node 39. The fourth diode D40 delivers the voltage signal at the reference node 31 supplied via the fourth capacitor C4 to the fourth reference voltage source 43. At the same time, it prevents a voltage from the fourth reference voltage source 43 from being applied to the fourth output node 39. The fourth capacitor C40 accumulates the fourth reference voltage Vref4 at the fourth output node 39. The voltage accumulated at the capacitor C40 on the basis of the voltage at the reference node 31 is output from the fourth output node 39. The voltage signal output from the fourth output node 39 has a voltage level varying in accordance with a logical value of the line pulse LS. For example, assuming that the fourth reference voltage 43 is set to "+4 V", the voltage signal at the fourth output node 39 is maintained at the level of "−0.2 V" during the period of even-numbered horizontal synchronous signals in which the line pulse LS has a logical value of "1", and at the level of "+4.0 V" during the period of odd-numbered horizontal synchronous signals in which the line pulse LS has a logical value of "0". The voltage signal at the fourth output node 39 is supplied to the gate drivers of the LCD panel, such as one shown in FIG. 1 as another gate driving voltage Vgh.

As described above, the voltage generating circuit for an LCD apparatus according to the present invention generates a plurality of voltage signals having different voltage levels by utilizing at least two capacitors as a voltage clamping device. Furthermore, the voltage generating circuit according to the present invention has a much simplified circuit configuration than conventional voltage generating circuits.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A voltage generating circuit for driving a liquid crystal display panel, comprising:

a reference node having a voltage level according to a line pulse;

at least two reference voltage sources for generating reference voltage signals; and at least two clamping means, coupled to said reference node and to said at least two reference voltage sources, for clamping the reference voltage signals from said at least two reference voltage sources according to said line pulse and for generating a plurality of voltage signals, each clamping means including a voltage charging and discharging device between said reference node and any one of said at least two reference voltage sources.

2. The voltage generating circuit as set forth in claim 1, further comprising:

buffer means for buffering the line pulse before the line pulse is applied to said reference node.

3. The voltage generating circuit as set forth in claim 1, further comprising:

at least two one-directional current devices coupled between said at least two voltage charging and discharging devices and said at least two reference voltage sources.

4. The voltage generating circuit as set forth in claim 3, wherein said at least two one-directional current devices are diodes.

5. The voltage generating circuit as set forth in claim 1, wherein each of said at least two clamping means is a capacitor.

6. The voltage generating circuit as set forth in claim 1, wherein the plurality of voltage signals generated by said at least two clamping means include a common voltage signal, a gate floating voltage signal, a first gate driving voltage signal and a second gate driving voltage signal for the liquid crystal display panel.

7. A voltage generating circuit for driving a liquid crystal display panel, comprising:

a reference node responsive to a line pulse;

at least two output nodes for outputting driving voltage signals;

at least two reference voltage sources supplying reference voltage signals to said at least two output nodes;

direction control means, coupled to said at least two reference voltage sources and to said at least two output nodes, for directing a flow of the reference voltage signals; and at least two voltage accumulating means, coupled to said reference voltage node and to said at least two reference voltage sources, for accumulating voltages to be output as the driving voltage signals, each voltage accumulating means including a voltage charging and discharging device between said reference node and any one of said at least two reference voltage sources.

8. The voltage generating circuit as set forth in claim 7, further comprising:

buffer means for buffering the line pulse to be applied to said reference node.

9. The voltage generating circuit as set forth in claim 7, wherein each of said at least two voltage accumulating means includes a capacitor.

10. The voltage generating circuit as set forth in claim 9, wherein each of said at least two direction control means includes a diode.

11. The voltage generating circuit as set forth in claim 7, wherein the driving voltage signals includes a common voltage, a gate floating voltage, and a plurality of gate driving voltages.

12. A voltage generating circuit for driving a liquid crystal display panel, comprising:

a reference node having a voltage level according to a line pulse;

a plurality of reference voltage sources for supplying reference voltage signals;

a plurality of capacitors, coupled to said reference node and to said reference voltage sources, for generating a plurality of driving voltage signals according to the line pulse, wherein said plurality of capacitors are commonly responsive to the voltage at the reference node to perform a voltage charging and discharging operation.

13. The voltage generating circuit as set forth in claim 12, wherein the number of said reference voltage sources equals the number of said capacitors.

14. The voltage generating circuit as set forth in claim 12, further comprising:

a buffer receiving the line pulse and applying a buffered line pulse to said reference node.

15. The voltage generating circuit as set forth in claim 13, further comprising:

a plurality of diodes coupled between said reference voltage sources and said capacitors.

16. The voltage generating circuit as set forth in claim 15, wherein the number of said reference voltage sources equals the number of said diodes.

17. The voltage generating circuit as set forth in claim 16, wherein the number of said diodes equals the number of said capacitors.

18. The voltage generating circuit as set forth in claim 17, wherein the number of said capacitors equals the number of said driving voltage signals.

19. The voltage generating circuit as set forth in claim 12, wherein said driving voltage signals include a common voltage signal, a gate floating voltage signal, a first gate driving voltage signal, and a second gate driving voltage signal for the liquid crystal display panel.

* * * * *